US009844233B2

(12) United States Patent
Chen

(10) Patent No.: US 9,844,233 B2
(45) Date of Patent: Dec. 19, 2017

(54) AIRFLOW PREHEATING DEVICE

(71) Applicant: Smiss Technology Co., Ltd., Shenzhen, Guangdong (CN)

(72) Inventor: Jiatai Chen, Guangdong (CN)

(73) Assignee: SMISS TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/269,256

(22) Filed: Sep. 19, 2016

(65) Prior Publication Data

US 2017/0164653 A1 Jun. 15, 2017

Related U.S. Application Data

(63) Continuation of application No. PCT/CN2016/082258, filed on May 16, 2016.

(30) Foreign Application Priority Data

Dec. 15, 2015 (CN) ..... 2015 1 0934148

(51) Int. Cl.
*A24F 47/00* (2006.01)

(52) U.S. Cl.
CPC ..... *A24F 47/004* (2013.01); *A24F 47/008* (2013.01)

(58) Field of Classification Search
CPC ..... A24F 47/008; A24F 47/00; A24F 47/004
USPC ..... 131/329; 128/202.21
See application file for complete search history.

(56) References Cited

U.S. PATENT DOCUMENTS 1,262,846 A * 4/1918 Rider ..... F02M 31/18 123/550
4,036,224 A * 7/1977 Choporis ..... A61M 15/06 128/202.21
5,819,756 A * 10/1998 Mielordt ..... A24F 47/008 131/194

(Continued)

FOREIGN PATENT DOCUMENTS

CN 204070562 1/2015
CN 204070585 1/2015

(Continued)

OTHER PUBLICATIONS

International Search Report issued in the corresponding PCT application No. PCT/CN2016/082258, dated Jul. 22, 2016, 5 pages.

(Continued)

*Primary Examiner* — Abdullah Riyami
*Assistant Examiner* — Vladimir Imas
(74) *Attorney, Agent, or Firm* — Hamre, Schumann, Mueller & Larson, P.C.

(57) ABSTRACT

An airflow preheating device, includes a heating pipe and a flow guide pipe, where the flow guide pipe is embedded in the heating pipe; a flow guide device is provided on an outer wall of the flow guide pipe; a ventilation pipe is provided inside the flow guide pipe; an air flow space is formed between the ventilation pipe and the flow guide pipe; an air flow enters between the flow guide pipe and the ventilation pipe from a top end of the ventilation pipe, and then enters between the outer wall of the flow guide pipe and an inner wall of the heating pipe via an air flow hole on a wall of the flow guide pipe, and flows out via the flow guide device. Because an optimized air flow channel is used, an outer wall of a smoking set is not easily heated.

12 Claims, 3 Drawing Sheets

(56) References Cited

U.S. PATENT DOCUMENTS

| | | | | |
|---|---|---|---|---|
| 6,040,560 | A * | 3/2000 | Fleischhauer | A24F 47/008 128/202.21 |
| 6,089,857 | A * | 7/2000 | Matsuura | A61M 15/06 131/329 |
| 6,116,247 | A * | 9/2000 | Banyasz | A24F 47/008 131/243 |
| 8,511,318 | B2 * | 8/2013 | Hon | A24F 47/002 128/202.21 |
| 8,733,345 | B2 * | 5/2014 | Siller | A24F 47/006 128/202.21 |
| 8,833,364 | B2 * | 9/2014 | Buchberger | A61M 11/041 128/200.14 |
| 8,857,446 | B2 * | 10/2014 | Wu | A24F 47/008 128/202.21 |
| 8,948,578 | B2 * | 2/2015 | Buchberger | A61M 11/041 128/203.27 |
| 9,038,626 | B2 * | 5/2015 | Yamada | A61M 11/041 128/200.21 |
| 9,078,473 | B2 * | 7/2015 | Worm | A24F 47/008 |
| 9,254,007 | B2 * | 2/2016 | Liu | A24F 47/008 |
| 9,271,527 | B2 * | 3/2016 | Liu | A24F 47/002 |
| 9,364,027 | B2 * | 6/2016 | Hon | A24F 47/002 |
| 9,623,205 | B2 * | 4/2017 | Buchberger | A24F 47/008 |
| 9,648,909 | B2 * | 5/2017 | Zhou | A24F 47/008 |
| 9,675,113 | B2 * | 6/2017 | Liu | A24F 47/008 |
| 9,687,027 | B2 * | 6/2017 | Poston | A24F 47/008 |
| 9,687,029 | B2 * | 6/2017 | Liu | H05B 3/16 |
| 2008/0149118 | A1 * | 6/2008 | Oglesby | A61M 11/047 131/194 |
| 2010/0043809 | A1 * | 2/2010 | Magnon | A24F 47/006 131/178 |
| 2010/0083959 | A1 * | 4/2010 | Siller | A24F 47/006 128/202.21 |
| 2011/0011396 | A1 * | 1/2011 | Fang | A24F 47/008 128/202.21 |
| 2011/0303231 | A1 * | 12/2011 | Li | A24F 47/008 131/329 |
| 2012/0145169 | A1 * | 6/2012 | Wu | A24F 47/008 131/273 |
| 2012/0260927 | A1 * | 10/2012 | Liu | A24F 47/008 131/329 |
| 2013/0228191 | A1 * | 9/2013 | Newton | A24F 47/008 131/329 |
| 2015/0053216 | A1 * | 2/2015 | Liu | A24F 47/008 131/329 |

FOREIGN PATENT DOCUMENTS

| | | |
|---|---|---|
| CN | 104522889 | 4/2015 |
| CN | 104522891 | 4/2015 |
| CN | 104544559 | 4/2015 |
| CN | 104585886 | 5/2015 |
| CN | 204317499 | 5/2015 |
| CN | 104921306 | 9/2015 |
| CN | 204670383 | 9/2015 |
| CN | 105411004 | 3/2016 |
| CN | 205233472 | 5/2016 |
| WO | 2014177862 | 11/2014 |

OTHER PUBLICATIONS

Office Action issued for Chinese Patent Application Serial No. 201510233789.X, dated Mar. 1, 2017, 6 pages. Chinese only.

* cited by examiner

AIRFLOW PREHEATING DEVICE

BACKGROUND

Technical Field

The present application relates to the field of smoking set, and more specifically, to an airflow preheating device.

Related Art

In the current society, smoking sets, as alternatives of traditional cigarettes, have been gradually developed; smoking sets generally generate smoke by using tobacco tars as raw materials to perform atomization, and cannot replace traditional cigarettes in tastes; however, traditionally cigarettes cannot be sufficiently fire-cured when being fire-cured, and generate too many harmful substances. Cigarettes can be fired-cured and distilled by using a heating device, so as to reduce generation of harmful substances and achieve an effect of smoking real cigarettes.

In the prior art, an airflow preheating device is included in a process of fire-curing and distilling cigarettes, so as to heat an entering air flow so as to guide the hot air flow into cigarettes for distillation in the next step. However, because an air flow channel design of the existing airflow preheating device is unreasonable, a temperature of an outer wall of a smoking set is too high, resulting in generation of scorching hot feelings, thereby bringing bad use feelings for a user of the smoking set.

SUMMARY

The present application provides an airflow preheating device, which aims to resolve the problem that because an air flow channel of the airflow preheating device in the prior art is unreasonable, an outer wall of a smoking set is too hot.

To achieve the foregoing objective, an airflow preheating device is provided, where the airflow preheating device includes a heating pipe and a flow guide pipe, where a lower end of the flow guide pipe is provided with an opening and an upper end of the flow guide pipe is closed; upper and lower ends of the heating pipe are separately provided with an opening; the flow guide pipe is embedded in the heating pipe; an outer wall of the flow guide pipe is provided with a flow guide device; a lower end wall of the flow guide pipe is provided with an air flow hole; a ventilation pipe is provided inside the flow guide pipe; the ventilation pipe is a hollow pipe, two ends of which are separately provided with an opening; an outer diameter of the ventilation pipe is less than an inner diameter of the flow guide pipe, so as to form an air flow space between an outer wall of the ventilation pipe and an inner wall of the flow guide pipe; a maximum outer diameter of the flow guide device on the outer wall of the flow guide pipe is less than or equal to an inner diameter of the heating pipe; air enters the ventilation pipe from a lower end; an air flow enters an area between the inner wall of the flow guide pipe and the outer wall of the ventilation pipe from a top end of the ventilation pipe, and then enters a space formed between the outer wall of the flow guide pipe and an inner wall of the heating pipe via the air flow hole on the wall of the flow guide pipe, and the flow guide device guides the air flow to flow out from a top end of the flow guide pipe from bottom to top.

Further, the flow guide device is a helical or stepped flow guide vane.

Further, the heating pipe, the flow guide pipe, and the ventilation pipe are all hollow cylindrical structures.

Further, a temperature sensor is provided on an outer wall of the heating pipe or inside the heating pipe.

Further, the heating pipe is a ceramic, glass, or metal heating body.

Further, an isolation pipe is further provided outside the heating pipe; a thermal insulating material or a thermal insulating device is provided between the isolation pipe and the heating pipe.

Further, the heating pipe is connected to a heating circuit, so as to control a heating temperature of the heating pipe.

Further, a base is further included, where the base is provided on a bottom part of the heating pipe, flow guide pipe, and ventilation pipe, and is fixedly connected to the bottom part of the heating pipe, flow guide pipe, and ventilation pipe.

Further, an air inlet pipe is further connected to a lower part of the base, where the air inlet pipe is connected to the ventilation pipe via a through hole on the base.

Further, a length of the flow guide pipe is less than or equal to a length of the heating pipe.

Further, a filter screen is provided above the top end of the flow guide pipe in the heating pipe.

Further, the top end of the heating pipe is connected to an upper holding ring by means of a silicon seal, and a material of the silicon ring is PEEK, PTFE, PPL, or PI.

According to the present application, by providing a double-U shaped air flow channel on an inner wall of the heating pipe, a gas has sufficient heating time in the preheating device, and because the air flow channel is completely located inside the heating pipe, and a thermal insulating material is provided outside the heating pipe, a temperature of a hot air flow is not easily transferred to an outer wall of a smoking set, thereby enabling a use feeling of the smoking set to be better.

| | | | |
|---|---|---|---|
| 1 | Heating pipe | 2 | Flow guide pipe |
| 3 | Ventilation pipe | 4 | Air inlet pipe |
| 5 | Base | 6 | Isolation pipe |
| 7 | Temperature sensor | 8 | Filter screen |
| 22 | Flow guide vane | 23 | Air flow hole |
| 9 | Upper holding ring | | |

DETAILED DESCRIPTION

The following describes specific implementation processes and implementation effects of the present application in detail with reference to the accompanying drawings.

Figure 1:
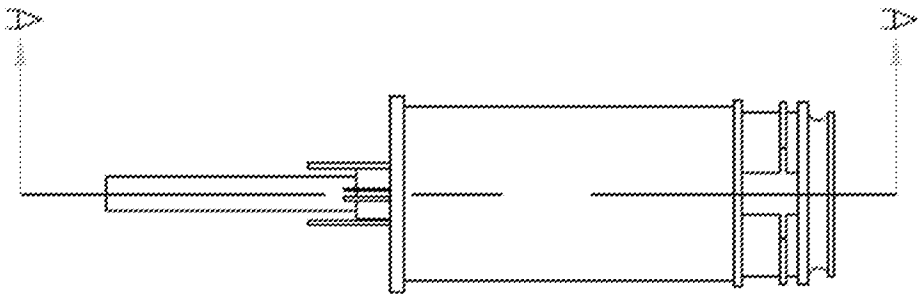
FIG. 1 is a front view of an embodiment of the present application.
Figure 2:
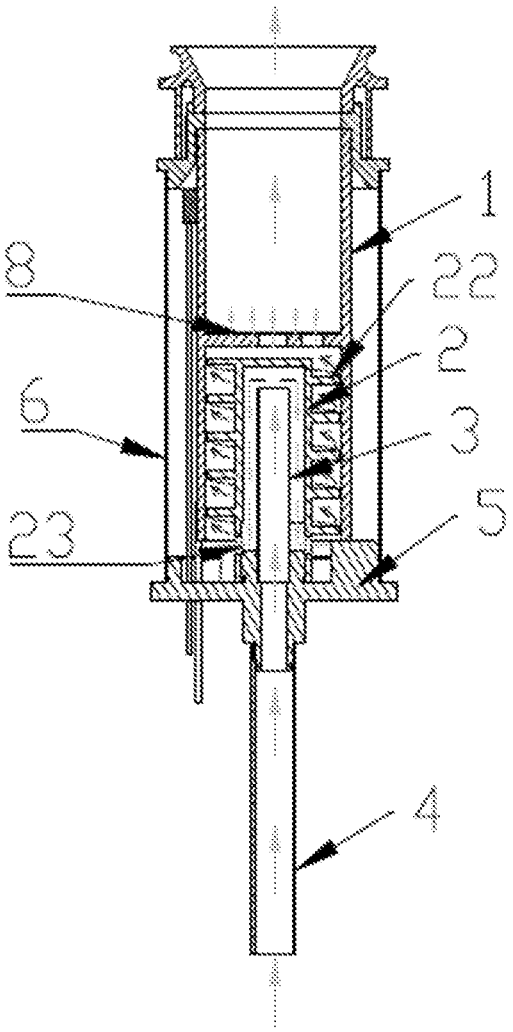
FIG. 2 is a section view in an A-A direction of FIG. 1.
Figure 3:
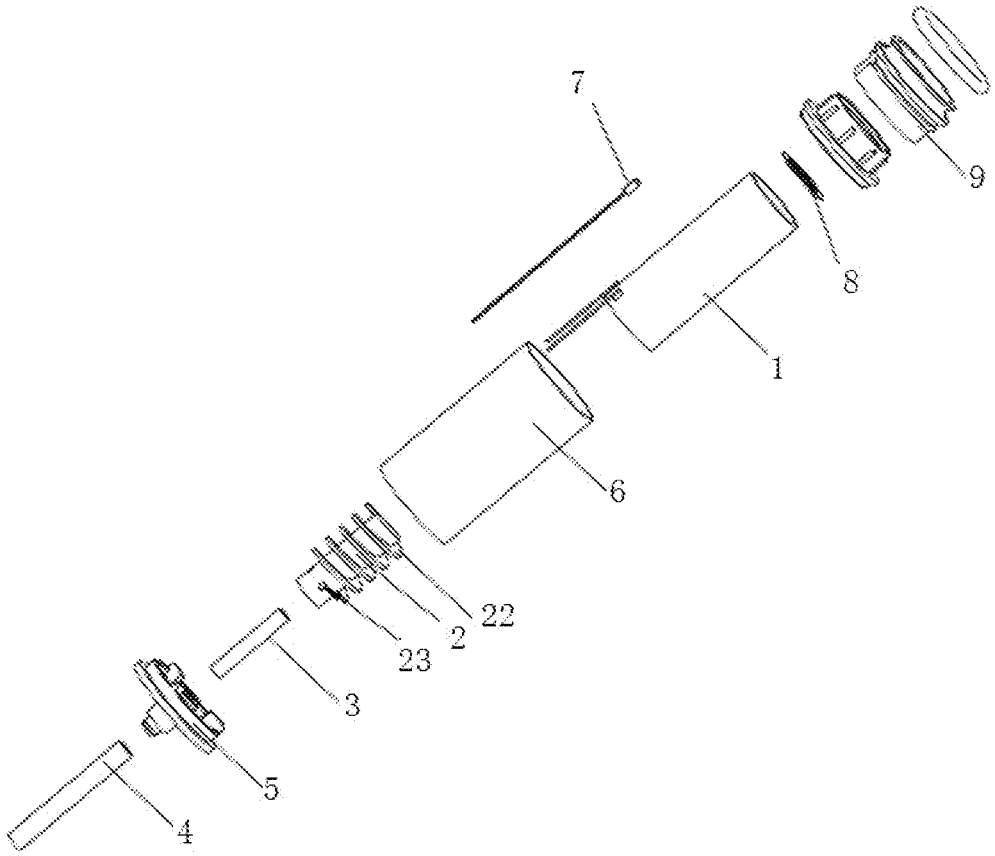
FIG. 3 is an exploded view of an embodiment of the present application.

As shown in FIG. 1 and FIG. 2, an airflow preheating device includes a heating pipe 1 and a flow guide pipe 2; the heating pipe 1 and the flow guide pipe 2 are hollow cylindrical structures; a lower end of the flow guide pipe 2 is provided with an opening and an upper end of the flow guide pipe 2 is closed; upper and lower ends of the heating pipe 1 are separately provided with an opening; the flow guide pipe 2 is embedded in the heating pipe 1; a length of a wall of the flow guide pipe 2 is less than or equal to a length of the heating pipe 1, and the length of the flow guide pipe 2 is determined by product attributes of a smoking set. As shown in FIG. 3, the heating pipe 1 uses a heating body made of materials, for example, ceramics, glass, or metal;

the heating pipe is connected to a heating circuit, and a temperature sensor 7 is provided on an outer wall or inside the heating pipe 1; the temperature sensor 7 and the heating circuit together control a heating temperature of the heating pipe 1.

As shown in FIG. 2 and FIG. 3, a flow guide device is provided on an outer wall of the flow guide pipe 2; the flow guide device may be a helical guide flow vane 22 or a guide flow vane 22 in other shapes; an air flow hole 23 is provided on a lower end wall of the flow guide pipe.

Further as shown in FIG. 2, a ventilation pipe 3 is provided inside the flow guide pipe 2; the ventilation pipe 3 is a hollow pipe, two ends of which are separately provided with an opening; an outer diameter of the ventilation pipe 3 is less than an inner diameter of the flow guide pipe 2, so as to form an air flow space between an outer wall of the ventilation pipe 3 and an inner wall of the flow guide pipe 2; a maximum outer diameter of the helical guide flow vane 22 on the outer wall of the flow guide pipe 2 is less than or equal to an inner diameter of the heating pipe; that is, the flow guide pipe can be smoothly stuffed into the heating pipe; however, a small gap is kept between the helical guide flow vane 22 and an inner wall of the heating pipe 1 or they are tightly adhered to each other.

With reference to an air flow arrow flow direction in FIG. 2, an air flow enters the ventilation pipe 3 from a lower end, and enters an area between the inner wall of the flow guide pipe 2 and the outer wall of the ventilation pipe 3 via a top end opening of the ventilation pipe 3, and then enters a space formed between the outer wall of the flow guide pipe 2 and an inner wall of the heating pipe 1 via the air flow hole 23 on a lower end of the flow guide pipe 2; the helical guide flow vane 22 guides the air flow to flow out from a top end of the flow guide pipe from bottom to top; during the process, the heating pipe 1 continuously heats the air flow, so that the air flow is a hot air flow when coming out from the top end of the heating pipe.

To further ensure that a user of a smoking set is not burnt by the heated smoking set when holding the smoking set, an isolation pipe 6 is further provided outside the heating pipe 1; the isolation pipe 6 is a stainless steel pipe material; a thermal insulating material or a thermal insulating device is provided between the isolation pipe 6 and the heating pipe 1; a vacuum layer may be selected as the thermal insulting device, and a heat-resistant silicon ring may be selected as the thermal insulating material.

Further, a base 5 is further included; a through hole is provided at the center of the base; the base 5 is provided on a bottom part of the heating pipe 1, flow guide pipe 2, and ventilation pipe 3, is fixedly connected to the bottom part of the heating pipe 1, flow guide pipe 2, and ventilation pipe 3, and supports the heating pipe 1, flow guide pipe 2, and ventilation pipe 3; PEEK may be selected as a material of the base, so that the base has a good appearance and is heat-resistant.

To further facilitate air inflow, an air inlet pipe 4 is further connected to a lower part of the base 5; the air inlet pipe 4 is connected to the ventilation pipe 3 via a through hole on the base; an air flow enters from the air inlet pipe 4, enters the ventilation pipe 3 via the through hole on the base, and circulates from bottom to up via the ventilation pipe 3.

Further, to prevent dregs generated by cigarettes provided above the smoking set from leaking into the preheating device below, a filter screen 8 is provided above the top end of the flow guide pipe 2 in the heating pipe 1; the top end of the heating pipe 1 is connected to an upper holding ring 9 by means of a silicon seal, and the upper holding ring uses the material PEEK.

Preferable embodiments of the present application are described above with reference to the accompanying drawings, and the embodiments are not intended to limit the scope of claims of the present application. Any modification, equivalent substitution, or improvement that does not deviate from the scope and essence of the present application and is made by a person skilled in the art should fall within the scope of claims of the present application.

What is claimed is:

1. An airflow preheating device, comprising a heating pipe and a flow guide pipe, wherein a lower end of the flow guide pipe is provided with an opening and an upper end of the flow guide pipe is closed; upper and lower ends of the heating pipe are separately provided with an opening; the flow guide pipe is embedded in the heating pipe; an outer wall of the flow guide pipe is provided with a flow guide device; a lower end wall of the flow guide pipe is provided with an air flow hole; a ventilation pipe is provided inside the flow guide pipe; the ventilation pipe is a hollow pipe, two ends of which are separately provided with an opening; an outer diameter of the ventilation pipe is less than an inner diameter of the flow guide pipe, so as to form an air flow space between an outer wall of the ventilation pipe and an inner wall of the flow guide pipe; a maximum outer diameter of the flow guide device on the outer wall of the flow guide pipe is less than or equal to an inner diameter of the heating pipe; air enters the ventilation pipe from a lower end; an air flow enters an area between the inner wall of the flow guide pipe and the outer wall of the ventilation pipe from a top end of the ventilation pipe, and then enters a space formed between the outer wall of the flow guide pipe and an inner wall of the heating pipe via the air flow hole on the wall of the flow guide pipe, and the flow guide device guides the air flow to flow out from a top end of the flow guide pipe from bottom to top.

2. The airflow preheating device according to claim 1, wherein the flow guide device is a helical or stepped flow guide vane.

3. The airflow preheating device according to claim 1, wherein the heating pipe, the flow guide pipe, and the ventilation pipe are all hollow cylindrical structures.

4. The airflow preheating device according to claim 1, wherein a temperature sensor is provided on an outer wall of the heating pipe or inside the heating pipe.

5. The airflow preheating device according to claim 4, wherein the heating pipe is a ceramic, glass, or metal heating body.

6. The airflow preheating device according to claim 1, wherein an isolation pipe is further provided outside the heating pipe; a thermal insulating material or a thermal insulating apparatus is provided between the isolation pipe and the heating pipe.

7. The airflow preheating device according to claim 1, wherein the heating pipe is connected to a heating circuit, so as to control a heating temperature of the heating pipe.

8. The airflow preheating device according to claim 1, further comprising a base, wherein the base is provided on a bottom part of the heating pipe, flow guide pipe, and ventilation pipe, and is fixedly connected to the bottom part of the heating pipe, flow guide pipe, and ventilation pipe.

9. The airflow preheating device according to claim 8, wherein an air inlet pipe is further connected to a lower part of the base, wherein the air inlet pipe is connected to the ventilation pipe via a through hole on the base.

10. The airflow preheating device according to claim 1, wherein a length of the flow guide pipe is less than or equal to a length of the heating pipe.

11. The airflow preheating device according to claim 1, wherein a filter screen is provided above the top end of the flow guide pipe in the heating pipe.

12. The airflow preheating device according to claim 1, wherein the top end of the heating pipe is connected to an upper holding ring by means of a silicon seal, and a material of the silicon ring is PEEK, PTFE, PPL, or PI.

* * * * *